United States Patent [19]

Shoji et al.

[11] Patent Number: 5,032,829

[45] Date of Patent: Jul. 16, 1991

[54] THIN FILM EL DISPLAY DEVICE

[75] Inventors: Kazuo Shoji; Toshihiro Ohba, both of Nara; Akio Inohara, Osaka; Hiroshi Kishishita, Nara; Hisashi Ueda, Wakayama, all of Japan

[73] Assignee: Sharp Kabushiki Kaisha, Osaka, Japan

[21] Appl. No.: 244,841

[22] Filed: Sep. 15, 1988

[30] Foreign Application Priority Data

Sep. 16, 1987 [JP] Japan ..... 62-231745

[51] Int. Cl.[5] ..... G09G 3/00

[52] U.S. Cl. ..... 340/781; 340/760

[58] Field of Search ..... 340/781, 760, 825.81, 340/805, 811, 762, 782

[56] References Cited

U.S. PATENT DOCUMENTS 3,651,493 3/1972 Ngo ..... 340/781

3,781,851 12/1973 Alexander ..... 340/781

4,109,245 8/1978 Hedin ..... 340/760

FOREIGN PATENT DOCUMENTS

WO83/03021 9/1983 PCT Int'l Appl. ..... 340/781

*Primary Examiner*—Alvin Oberley

[57] ABSTRACT

A thin film EL display device is described which comprises a group of parallel scanning electrodes, a group of parallel data electrodes laid so as to extend perpendicular to the group of the scanning electrodes, and an EL layer disposed between the respective groups of the scanning and data electrodes. Each of the electrodes of at least one of the groups of the scanning and data electrodes which apply a writing voltage to the EL layer is connected with a driver circuit of high voltage breakdown characteristic having only a push-pull function or a pull-up and pull-down function. This driver circuit employs thyristors as switching elements.

20 Claims, 4 Drawing Sheets

THIN FILM EL DISPLAY DEVICE

BACKGROUND OF THE INVENTION

1. Field of the Invention

The present invention generally relates to an AC driven, capacitive flat matrix display panel, that is, a thin film EL device. More particularly, it relates to a drive circuit therefor.

2. Description of the Prior Art

By way of example, a double insulated (or triple-layered) thin film EL element is constructed in the following manner.

As shown in FIG. 6, the EL element shown therein comprises a glass substrate 101 having a group of strip-shaped transparent electrodes 102 made of $In_2O_3$ and deposited on one surface thereof in parallel relationship with each other. It includes a three-layered structure including a layer 103 of dielectric material such as, for example, $Y_2O_3$, $Si_3N_4$ or $Al_2O_3$, an EL layer 104 made of ZnS doped with an activator such as, for example, Mn and a layer 103' of dielectric material such as, for example, $Y_2O_3$, $Si_3N_4$ or $Al_2O_3$. This layer is sequentially formed over the group of the strip-shaped transparent electrodes 102 to a film thickness of 500 to 10,000 Å by the use of a thin film technology such as, for example, a vapor-deposition technique or a sputtering technique. Further, a group of strip-shaped counter-electrodes 105 made of aluminum are deposited over the three-layered structure in parallel relationship with each other so as to extend in a direction perpendicular to the group of the strip-shaped transparent electrodes 102.

The thin film EL element of the above described construction comprises a sandwich structure. The EL layer 104 is sandwiched between the dielectric layers 103 and 103' and is disposed between the groups of the electrodes 102 and 105. Thus, the thin film EL element in question can be considered an equivalent of a capacitance element. Also, as can be readily understood from the graph of FIG. 7 illustrating the voltage versus luminance characteristic, this thin film EL element of the above described construction is adapted to be driven by the application of a relatively high voltage, for example, about 200V. A further feature featured is that it can be energized by an alternating current field to emit rays of light of high luminance. Thus, it has a long liftime.

Hitherto, various drive circuits for the thin film EL element of the above described type have been proposed for the purpose of minimizing the consumption of an electric modulating power, the manufacturing cost and the thickness and/or size thereof.

In any one of the proposed drive circuits, it is a general practice to connect scanning electrodes and data electrodes with driver IC circuit having only a push-pull function or a pull-up, pull-down function. These switching elements are employed in the form of Nch MOS field-effect transistors, Nch transistors, Pch MOS field-effect transistors or Pch transistors. This is because they can contribute to the minimization of the manufacturing cost and the bulkiness and also to the accomplishment of a highly integrated feature.

It has, however, been found that, since these switching elements provide an output of low current and a high ON resistance, a phenomenon tends to occur wherein, in the EL display device, the lighting luminance tends to vary depending on the number of picture elements energized to light during the drive of one scanning line. This phenomenon is illustrated in FIG. 4 which illustrates a display screen of the EL display device. In FIG. 4, hatched bars 11 represents non-lighting portions and reference numeral 12 represents a lighting portion. Assuming that the lighting luminances at points (1), (2), (3) and (4) are expressed by B1, B2, B3 and B4, respectively, the luminances at these points have the following relationship.

$$B1 > B2 > B3 > B4$$

In other words, the increase of the number of picture elements which are energized to light results in reduction of the luminance. Therefore, the display quality tends to be lowered.

Where a gradation is desired to be displayed, this phenomenon cannot be neglected because it brings about a considerable adverse effect on the gradation display. By way of example, if the luminance at the point (4) is nine tenths (9/10) of the luminance at the point (1), the level of gradation at the point (1) which is 90% and the level of gradation at the point (4) which is 100%,are generally equal to each other. Therefore, a normal gradation display is impossible.

Also, when the display device is desired to be able to display a relatively large amount of information, that is, when the load capacitance of one scan line is desired to be increased as a result of the increased number of the data electrodes and the length of time required to accomplish one scan drive is desired to be reduced as a result of the increased number of the scanning electrodes, sufficient writing pulses cannot be applied because of the limitation imposed by the output current capacity and the ON resistance. Accordingly, no sufficient lighting luminance can be obtained.

As hereinabove discussed, there has been a problem associated with the improvement in display quality exhibited by the thin film EL display device.

SUMMARY OF THE INVENTION

The present invention has been devised with a view to substantially eliminating the above discussed problem and has, for its object, to provide an improved thin film EL display device wherein a change in luminance, resulting from variation of the load capacitance of one scan line, is advantageously suppressed. Further it is capable of displaying a gradation and an increased number of information to be displayed.

In order to accomplish the above described object, there is provided a thin film EL display device which comprises a group of parallel scanning electrodes, a group of parallel data electrodes laid so as to extend perpendicular to the group of the scanning electrodes, and an EL layer disposed between the respective groups of the scanning and data electrodes. In accordance with the present invention, each of the electrodes of at least one of the groups of the scanning and data electrodes, which apply a writing voltage to the EL layer, is connected with a driver circuit of high voltage breakdown characteristic having only a push-pull function or a pull-up and pull-down function. This driver circuit employs thyristors as switching elements.

According to the present invention, each electrodes of one of the groups of the scanning and data electrodes, which applies the writing voltage to the EL layer, is connected with the driver circuit of high voltage breakdown characteristic having the push-pull function or the pull-up and pull-down function and employing the thyristors as switching elements. Thus each of the thyristors can be considered an equivalent diode, when the thyristors are applied with trigger pulses (i.e., driven on) at the time the writing voltage is applied to the EL layer. Therefore, since the current capacity and the ON resistance thereof depend on an external circuit, the current capacity and the ON resistances are sufficiently increased and reduced, respectively, as compared with MOS field-effect transistors. In other words, since the writing voltage can be applied in a relatively short period of time and regardless of the magnitude of the load capacitance, any possible change in luminance resulting from the change in load capacitance of one scan line can be advantageously suppressed and the increase of the capacity per scan line and the reduction in time required to accomplish one scan drive can also be achieved. Thus, a thin film EL display device capable of displaying an increased amount of information can be realized.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1A:
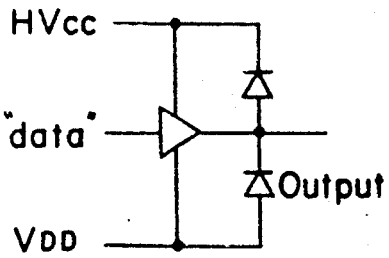
FIGS. 1(*a*) and 1(*b*) and FIG. 2 are diagrams illustrating a drive circuit for a thin film EL display device according to one embodiment of the present invention.
Figure 1B:
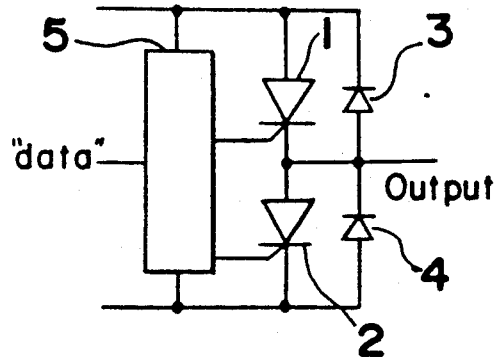
Figure 4:
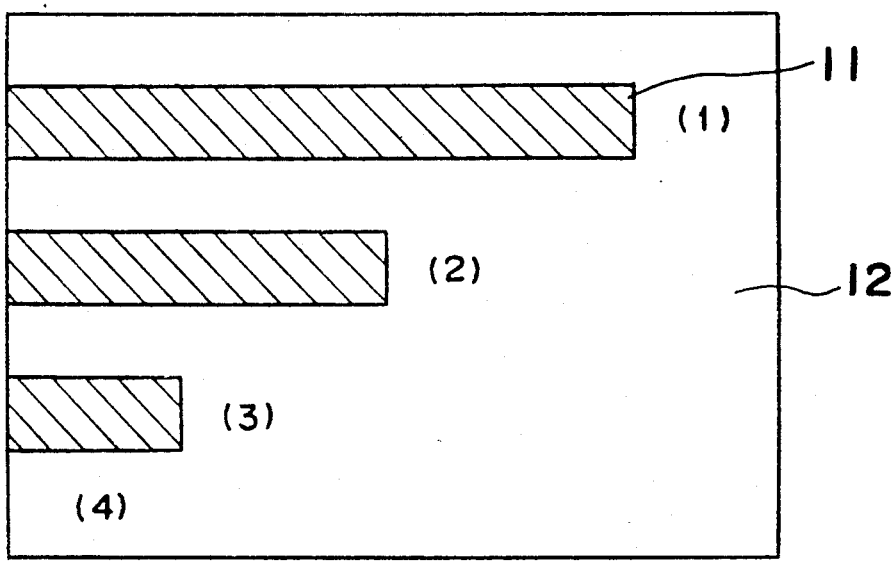
FIG. 4 is a diagram showing a display screen of the thin film EL display device illustrating change in luminance with change in number of the picture elements energized to light.
Figure 2:
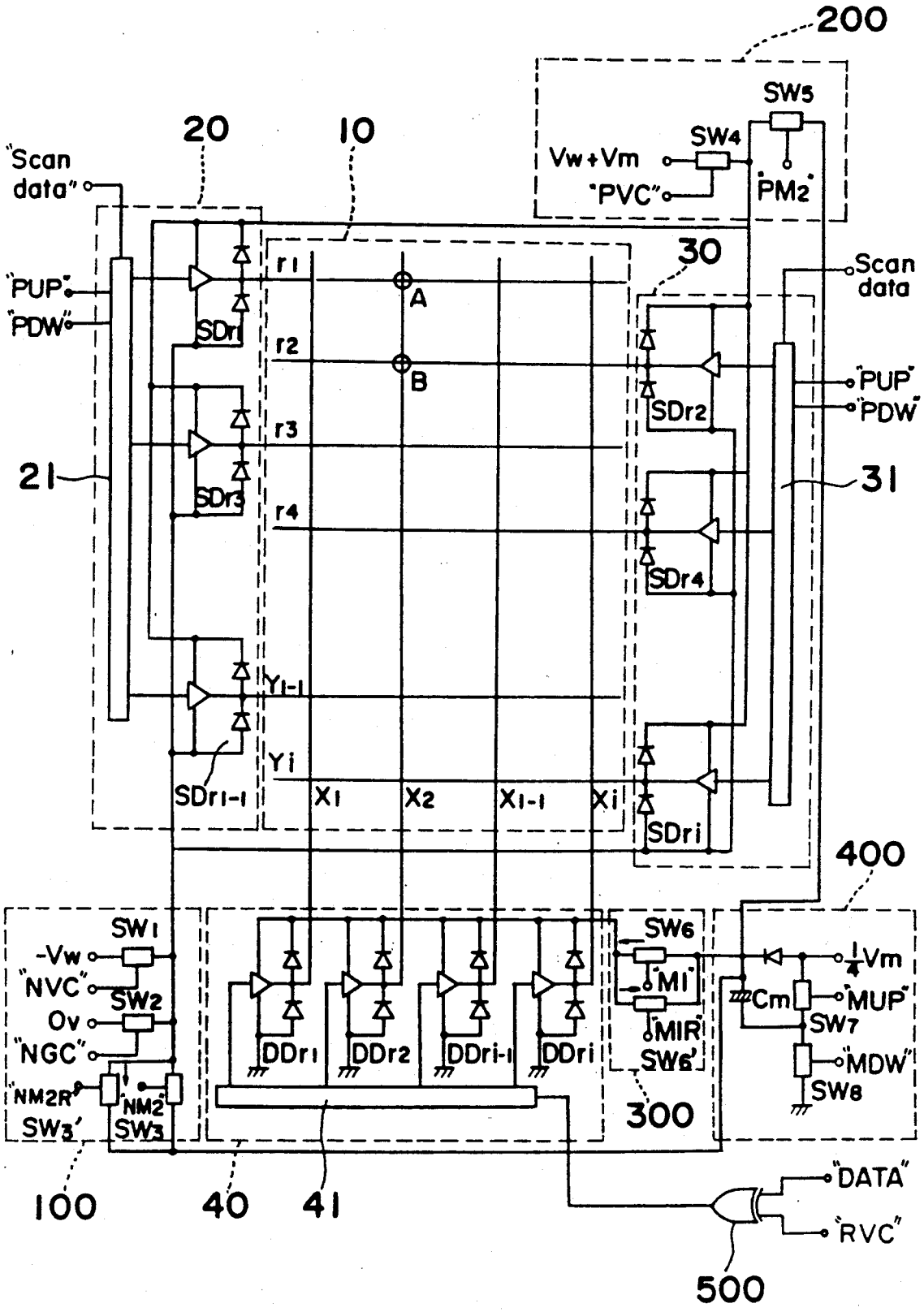

Referring to FIGS. 1(*a*) and 1(*b*) and FIG. 2 showing a drive circuit according to one embodiment of the present invention, reference numeral 1 represents a thyristor employed as a pull-up switching element in a push-pull bidirectional driver IC circuit of high voltage breakdown characteristic. Reference numeral 2 represents a thyristor employed as a pull-down switching element. Reference numerals 3 and 4 represent respective diodes used to supply an electric current to the associated thyristors 1 and 2 in a reverse direction. Reference numeral 5 represents a drive circuit and a control logic circuit for providing a trigger pulse to the thyristors 1 and 2.

Reference numeral 10 represents a thin film EL display device having a lighting threshold voltage Vth ($VW < Vth < Vw + Vm$). However, it is to be noted that a column of electrodes, which serve as data electrodes, and a row of electrodes which serve as scanning electrodes are illustrated in FIG. 2 to show the thin film EL display device 10.

Reference numerals 20 and 30 represent scanning-side push-pull bidirectional driver IC circuits of high voltage breakdown characteristic associated respectively with the odd-numbered and even-numbered lines of the row of the scanning electrodes. Each of the driver IC circuits 20 and 30 has a logic circuit 21 or 31 such as, for example, a shift register, which is operable in response to a control signal such as "PDW" to create a condition in which a pull-up element or a pull-down element can be turned ON in correspondence with "Scan data" in the shift register. It also creates a condition in which the pull-up element or the pull-down element can be turned ON regardless of "Scan data".

Reference numeral 40 represents a data-side push-pull bidirectional driver IC circuit of high voltage breakdown characteristic associated with the column of the data electrodes and including a logic circuit 41 such as, for example, a shift register.

Reference numeral 100 represents a switching circuit for switching a pull-down common line potential of the scanning-side driver IC circuits 20 and 30. This switching circuit 100 is comprised of switches SW1, SW2 and SW3 operable in response to respective control signals "NVC", "NGC" and "NM2" to switch over between a writing voltage $-Vw$ of negative polarity, 0V and a modulation voltage $\frac{1}{2}$ Vm, and a switch SW3' capable of switching in a direction reverse to that of the switch SW3 in response to a control signal "NM2R".

Reference numeral 200 represents a switching circuit for switching a pull-up common line potential of the scanning-side driver IC circuits 20 and 30. This switching circuit 200 is comprised of switches SW4 and SW5 operable in response to respective control signals "PVC" and "PM2" to switch over between a writing voltage $Vw + Vm$ of positive polarity and the modulation voltage $\frac{1}{2}$ Vm.

Reference numeral 300 represents a switching circuit for switching a pull-up common line potential of the data-side driver IC circuit 40. This switching circuit 300 is comprised of a switch SW6 operable in response to a control signal "M1" to switch over between the modulation voltage $\frac{1}{2}$ Vm and a floating condition, and a switch SW6' operable in response to a control signal "M1R" to perform a switching operation in a direction reverse to that of the switch SW6.

Reference numeral 400 represents a power supply circuit operable in response to a control signal "MDM" to switch a switch SW8 on to charge a modulation voltage $\frac{1}{4}$ Vm on a capacitor Cm. It is also operable in response to a control signal "MUP" to switch the switch SW8 off subsequent to the charging on the capacitor Cm and to switch a switch SW7 on to supply a modulation voltage $\frac{1}{2}$ Vm subsequent to the supply of the modulation voltage $\frac{1}{4}$ Vm. This power supply circuit 400 is connected with the switches SW3, SW5 and SW6 adapted to be controlled by the respective control signals "NM2", "PM2" and "M1". On the other hand, when the switch SW3' or a switch SW6' is switched on in response to the control signal "NM2R" or the control signal "M1R" and the switch SW8 is switched on in response to the control signal "MDW", this power supply circuit 40 operates to cause a portion of energies accumulated in the EL display device to be stored in the capacitor Cm.

Reference numeral 500 represents a data reversal control circuit.

Figure 3:
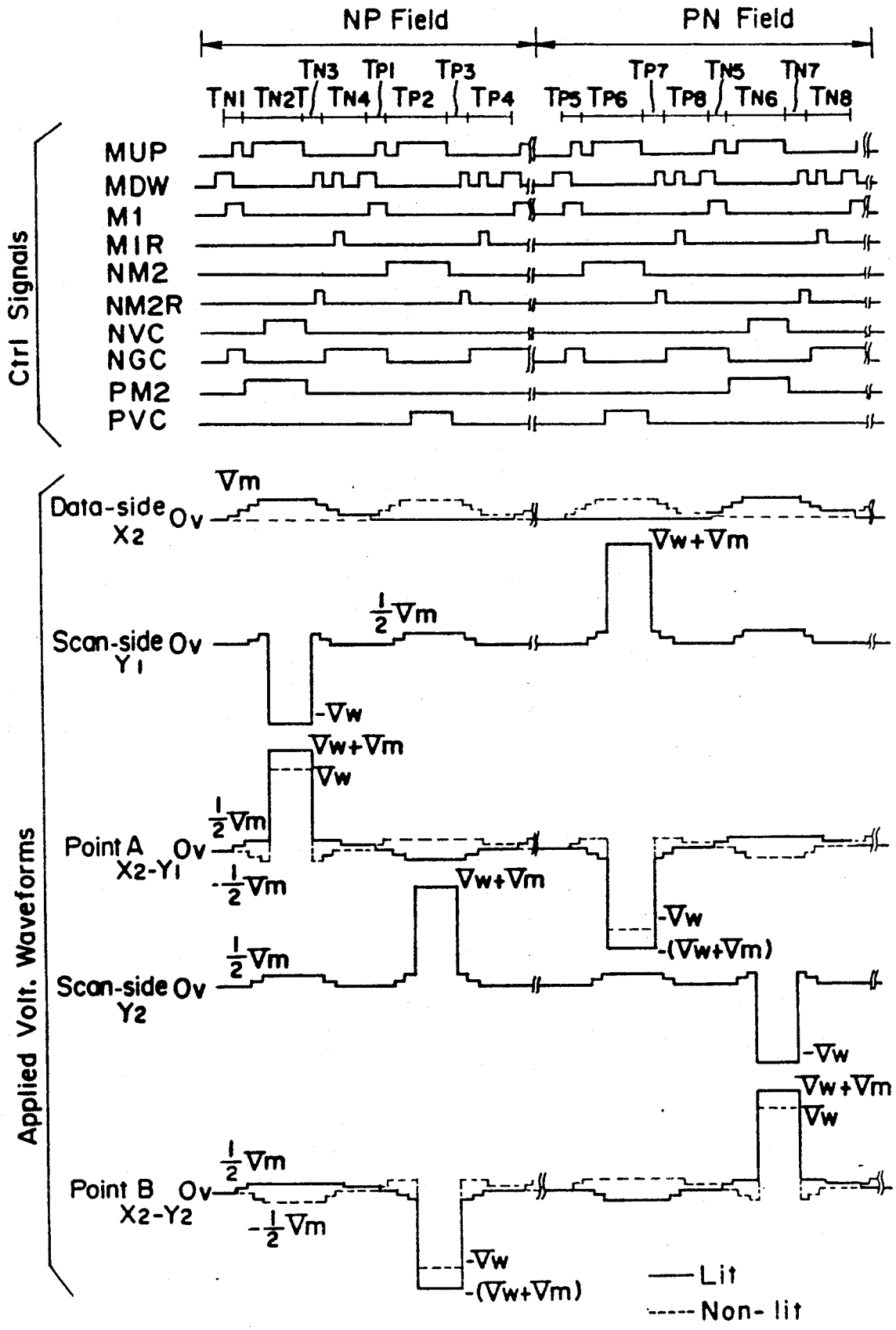
FIG. 3 illustrates a timing chart used to explain the operation of the circuit shown in FIG. 2 and waveforms of various voltages applied to picture elements.
Figure 6:
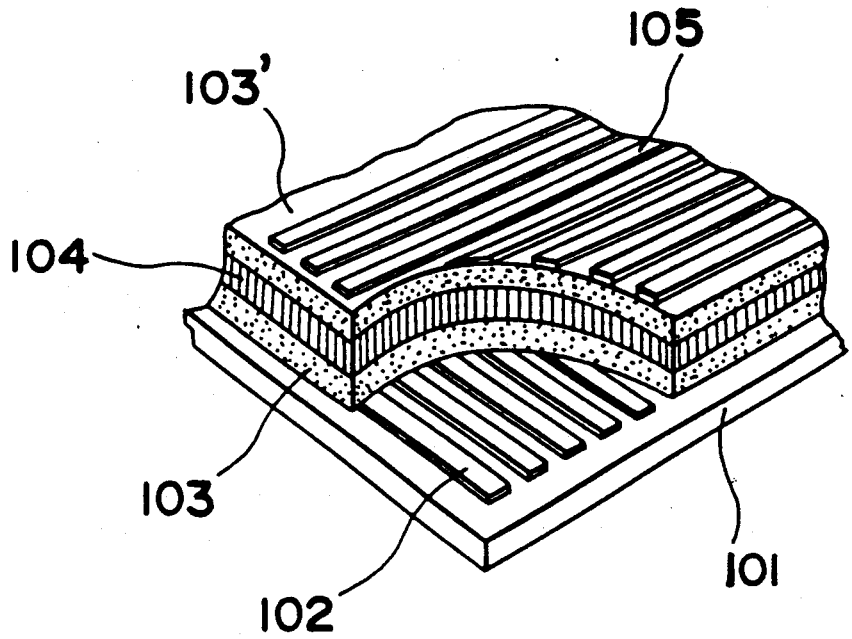
FIG. 6 is a schematic perspective view, with a portion cut away, of the thin film EL display device.
Figure 7:
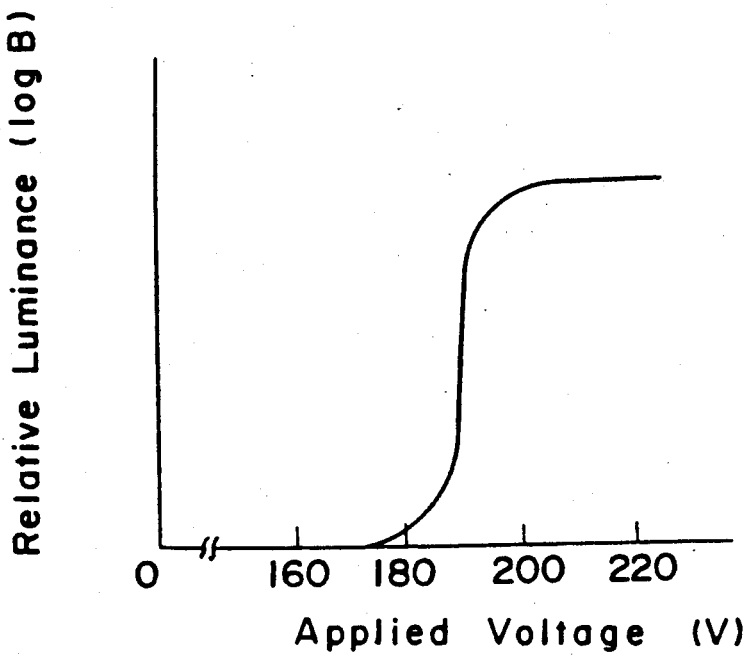
FIG. 7 is a graph showing the applied voltage versus luminance characteristic of the thin film EL display device.

The operation of the circuit shown in FIGS. 1(*a*) and 1(*b*) and FIG. 2 will now be described with reference to the timing chart shown in FIG. 3.

For the purpose of the description of the present invention, it is assumed that the scanning electrode Y1, including a picture element A, and the scanning electrode Y2, including a picture element B, are selected by a line sequence drive. Also, while this drive device is driven by reversing the polarity of the writing voltage applied to the picture element per line, the one-line driving timing during which the pull-down thyristors in the driver IC circuits 20 and 30 connected with the group of the scanning electrodes are triggered on to apply the negative writing pulse to the associated picture elements on the electrode lines is hereinafter referred to as the "N-drive timing". Further, the one-line driving timing during which the pull-up thyristors in the driver IC circuits 20 and 30 are triggered on to apply the positive writing pulse to the associated picture elements on the electrode lines is hereinafter referred to as the "P-drive timing". Also, the field (picture) in which an N-drive and a P-drive are effected to the odd-numbered scanning-side lines and the even-numbered scanning-side lines is hereinafter referred to as the "NP field", and the converse is referred to as the "PN field".

(A) NP Field

1. First Modulation Voltage Charging Period (TN1) During N-Drive

All of the scanning electrodes are retained at 0 volts by causing the pull-down thyristors of all scanning-side drivers SDr1 to SDri to be switched on and causing the switch SW2 to be switched on in response to the control signal "NGC". Simultaneously therewith, the switch SW6 is caused to be switched on in response to the control signal "M1". At this time, data-side drivers DDr1 to DDri cause the pull-up thyristors to be switched on when lighting is to be made according to a data signal "DATA". However, this causes the pull-down thyristors to be switched on when non-lighting is to be made. Assuming that the lighting takes place when a display data signal is "H" and the non-lighting takes place when the display data signal is "L", it is necessary for an input display data ("DATA") to be directly inputted to the data-side driver IC circuit 40. Therefore, a reversing signal "RVC" in the data reversal control signal is left to be "L". (However, it is assumed that, when the data signal is "H", the pull-up thyristors and the pull-down thyristors in the data-side driver IC circuit 40 are switched on and off, respectively. However, when the data signal is "L", the pull-up thyristors and the pull-down thyristors in the circuit 40 are switched off and on, respectively. Also, because of the line sequence drive taking place, the display data "DATA" is transferred during the previous line drive and retained by a latch.) Then, the switch SW8 is caused to be turned on in response to the control signal "MDW" to charge the voltage ¼ Vm on the capacitor Cm. Thereafter, by causing the switch SW7 to be switched on in response to the control signal "MUP" after the switch SW8 has been switched off in response to the control signal "MDW", a first modulation voltage of ½ Vm is stepwisely charged on a data-side only on lighting picture elements and will not be charged on non-lighting picture elements with the consequence that the potential on the data electrodes of the non-lighting picture elements becomes 0V. Upon the completion of the charging, the switches SW6 and SW7 are turned off.

2. Second Modulation Voltage Charging and Writing Period (TN2) During N-Drive

The pull-down thyristors only in the drivers connected with the selected scanning electrodes are turned on and the pull-up thyristors in the other scanning-side drivers are turned on. Simultaneously therewith, the modulation voltage ¼ Vm is applied to the pull-up common lines of all the scanning-side driver IC circuits 20 and 30 by causing the switch SW5 to be turned on in response to the control signal "PM2". Subsequently, the modulation voltage ½ Vm is applied thereto by causing the switch SW7 to be turned on in response to the control signal "MUP". Also, the negative writing voltage −Vw is applied to the pull-down common lines of all the scanning-side driver IC circuits 20 and 30 by causing the switch SW1 to be turned on in response to the control signal "NVC". On the other hand, the data-side driver IC circuit 40 continues the drive for the first modulation voltage charging period (TN1) during the above described N-drive.

Thereby, the modulation voltage ½ Vm is charged on the lighting picture elements on the data side during the first modulation voltage charging period (TN1) during the N-drive. Therefore, the potential at the data electrodes will be Vm. Also, since at the same time the negative writing voltage −Vw is applied to the selected scanning electrodes, the lighting picture elements are applied with the voltage $Vm-(-Vw)=Vw+Vm$ with the consequence that they are energized to light. Also, since the potential of the data electrodes of the non-lighting picture element is 0V and the negative writing voltage −Vw is applied to the selected scanning electrodes of the lighting picture elements as hereinabove described, the non-lighting picture elements are applied with the voltage $0V(-Vw)=Vw$. However, the non-lighting picture elements will not be energized because of the voltage being lower than the lighting threshold voltage Vth.

3. Writing Voltage Discharge and Second Modulating Voltage Recovery Period (TN3) During N-Drive When the pull-down thyristors of all the scanning-side drivers SDr1 to SDri are turned on after the switches SW1, SW5 and SW7 have been turned off in response to the respective control signals "NVC", "PM2" and "MUP", the writing voltage is discharged causing the potential at all the scanning electrodes to be ½ Vm. Then, by causing the switches SW3' and SW8 to be turned on in response to the respective control signals "NM2R" and "MDW", a portion of the charge accumulated during the second modulation voltage charging period (TN2}with the scanning electrodes being plus is charged on the capacitor Cm. This thereby renders the potential at all the scanning electrodes to be ¼ Vm. On the other hand, the potential of the electrodes connected with the lighting picture elements on the data electrodes becomes ¾ Vm.

4. Second Modulation Voltage Discharge and First Modulating Voltage Recovery Period (TN3) During N-Drive After the switches SW3' and SW8 have been turned off in response to the respective control signals "NM2R" and "MDW", the switching on of the switch SW2 in response to the control signal "NGC" results in the potential at the scanning electrodes becoming 0V. Also, the potential of the electrodes connected with the data-side picture elements becomes ½ Vm. By causing the switches SW6' and SW8 to be turned on in response to the respective control signals "M1R" and "MDW", a portion of the charge accumulated during the first modulation voltage charging period (TN1) with the data electrodes being plus is charged on the capacitor Cm. This thereby renders the potential at all the data electrodes to be ¼ Vm.

5. First Modulation Voltage Charging Period (TP1) During P-Drive

All of the scanning electrodes are retained at 0 volt by causing the pull-down thyristors of all scanning-side drivers SDr1 to SDri to be switched on and causing the switch SW2 to be switched on in response to the control signal "NGC". Simultaneously therewith, the switch SW6 is caused to be switched on in response to t he control signal "M1". At this time, data-side drivers DDr1 to DDri cause the pull-down thyristors to be switched on when lighting is to be made according to an inverted signal of the data signal "DATA", but causes the pull-up thyristors to be switched on when non-lighting is to be made. Since the inverted signal of the input display data signal "DATA" need be inputted to the data-side driver IC circuit 40, the reversing signal "RVC" in the data reversal control circuit 50 is left to be "H". Then, the switch SW8 is caused to be turned on in response to the control signal "MDW" to charge the voltage ¼ Vm on the capacitor Cm. Thereafter, by causing the switch SW7 to be switched on in response to the control signal "MUP" after the switch SW8 has been switched off in response to the control signal "MDW", the first modulation voltage of ¼ Vm is stepwisely charged on the data-side only on the non-lighting picture elements. At this time, no lighting picture element is charged and the potential on the data electrodes of the lighting picture elements becomes 0V. Upon the completion of the charging, the switches SW6 and SW7 are turned off.

6. Second Modulation Voltage Charging and Writing Period (TP2) During P-Drive

The pull-up thyristors only in the drivers connected with the selected scanning electrodes are turned on and the pull-down thyristors in the other scanning-side drivers are turned on. Simultaneously therewith, the positive writing voltage Vw+Vm is applied to the pull-up common lines of all the scanning-side driver IC circuits 20 and 30 by causing the switch SW4 to be turned on in response to the control signal "PVC". Also, the modulation voltage ¼ Vm is applied to the pull-down common lines of all the scanning-side driver IC circuits 20 and 30 by causing the switch SW3 to be turned on in response to the control signal "NM2". Subsequently, the modulation voltage ¼ Vm is applied thereto by causing the switch SW7 to be turned on in response to the control signal "MUP". On the other hand, the data-side driver IC circuit 40 continues the drive for the first modulation voltage charging period (TP1) during the above described P-drive.

Thus, since the second modulation voltage of ½ Vm is charged on the lighting picture elements on the data side and since at the same time the positive writing voltage Vw+Vm is applied to the selected scanning electrodes, the lighting picture elements are applied with the voltage $(Vw+Vm)-0V=VW+Vm$ with the consequence that they are energized to light. Also, since the modulation voltage ½ Vm is charged on the non-lighting picture elements on the data electrodes, the potential at the data electrode becomes Vm. At the same time, since the selected scanning electrodes are applied with the positive writing voltage Vw+Vm as hereinabove described, the non-lighting picture elements are applied with the voltage (Vw+Vm)−Vm=Vw. However, the non-lighting picture elements will not be energized because of the voltage being lower than the lighting threshold voltage Vth.

7. Writing Voltage Discharge and Second Modulating Voltage Recovery Period (TP3) During P-Drive When the pull-down thyristors of all the scanning-side drivers SDr1 to SDri are turned on after the switches SW4, SW3 and SW7 have been turned off in response to the respective control signals "PVC", "NM2" and "MUP", the writing voltage is discharged causing the potential at all the scanning electrodes to be ½ Vm. Then, by causing the switches SW3' and SW8 to be turned on in response to the respective control signals "NM2R" and "MDW", a portion of the charge accumulated during the second modulation voltage charging period (TP2) with the scanning electrodes being plus is charged on the capacitor Cm. This thereby renders the potential at all the scanning electrodes to be ¼ Vm. On the other hand, the potential of the electrodes connected with the non-lighting picture elements on the data electrodes becomes ¾ Vm.

8. Second Modulation Voltage Discharge and First Modulating Voltage Recovery Period (TP3) During P-Drive After the switches SW3' and SW8 have been turned off in response to the respective control signals "NM2R" and "MDW", the switching on of the switch SW2 in response to the control signal "NGC" results in that the potential at the scanning electrodes become 0V. Also, the potential of the electrodes connected with the data-side picture elements becomes ½ Vm. By causing the switches SW6' and SW8 to be turned on in response to the respective control signals "M1R" and "MDW", a portion of the charge accumulated during the first modulation voltage charging period (TP1) with the data electrodes being plus is charged on the capacitor Cm. This thereby renders the potential at all the data electrodes to be ¼ Vm.

(B) PN Field

1. First Modulation Voltage Charging Period (TP5) During P-Drive

The drive similar to that taking place during the first modulating charging period (TP1) under the NP field P-drive takes place.

2. Second Modulation Voltage Charging and Writing Period (TP6) During P-Drive

The drive similar to that taking place during the second modulation voltage charging and writing period (TP6) under the P-drive takes place.

3. Writing Voltage Discharge and Second Modulating Voltage Recovery Period (TP7) During P-Drive The drive similar to that taking place during the writing voltage discharge and second modulation voltage recovery period (TP7) under the P-drive takes place.

4. Second Modulation Voltage Discharge and First Modulating Voltage Recovery Period (TP8) During P-Drive The drive similar to that taking place during the second modulation voltage discharge and first modulation voltage recovery period (TP8) under the P-drive takes place.

5. First Modulation Voltage Charging Period (TN5) During N-Drive

The drive similar to that taking place during the first modulation voltage charging period (TN1) under the NP field N-drive takes place.

6. Second Modulation Voltage Charging and Writing Period (TN6) During N-Drive

The drive similar to that taking place during the second modulation voltage charging and writing period (TN2) under the NP field N-drive takes place.

7. Writing Voltage Discharge and Second Modulating Voltage Recovery Period (TN7) During N-Drive The drive similar to that taking place during the writing voltage discharge and second modulation voltage recover period (TN7) under the N-drive takes place.

8. Second Modulation Voltage Discharge and First Modulating Voltage Recovery Period (TN8) During N-Drive The drive similar to that taking place during the second modulation voltage discharge and first modulation voltage recovery period (TN4) under the N-drive takes place.

As hereinbefore discussed, the drive circuit herein disclosed has the NP and PN field drive timings such that, during the NP field, the N-drive and the P-drive are effected to the odd-numbered selection lines on the scanning side and the even-numbered selection lines on the scanning side, respectively. However, during the PN field, the drive, substantially reverse to that described above, is carried out for the purpose that alternating current pulses necessary to effect the lighting can be applied to all of the picture elements in the thin film EL display device. In FIG. 3, examples of waveforms of voltages applied to the picture elements A and B are illustrated.

Figure 5:
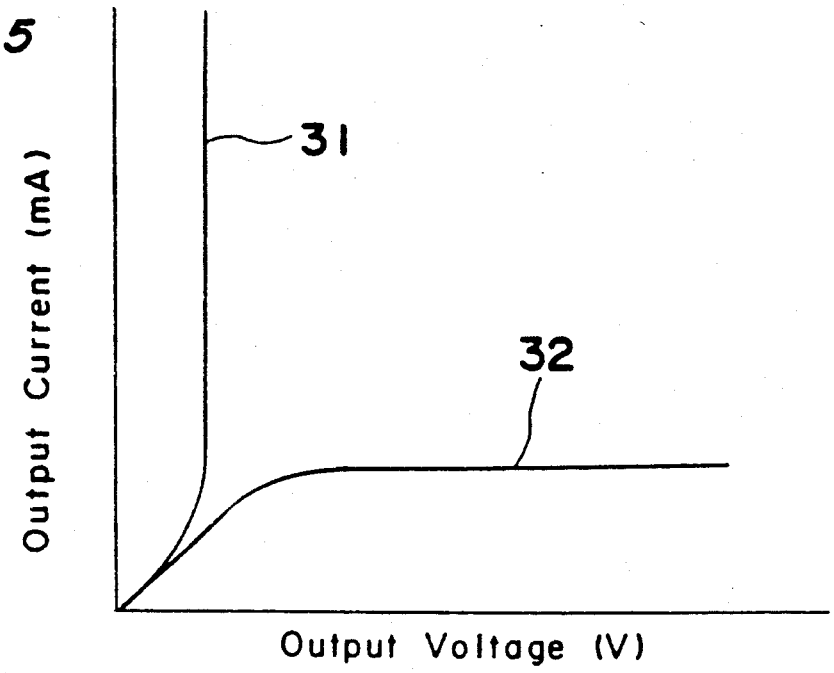
FIG. 5 is a graph showing the relationship between the output voltage and the current characteristic of switching elements of a driver IC circuit of high breakdown voltage characteristic.

In the meantime, in the conventional drive circuit, as switching elements in driver IC circuits of high voltage breakdown characteristic on the scanning side, Nch MOS field-effect transistors, Nch transistors, Pch MOS field-effect transistors or Pch transistors are generally employed. Therefore, not only are the reduction in manufacturing cost and size limited, but the extent to which it is highly integrated is also limited. Because of these limitations, the output current power tends to be low and the ON resistance tends to be high. The use of the thyristors for these switching elements of high voltage breakdown characteristic brings about such an advantage that the considerable reduction of the manufacturing cost and the size and the highly integrated feature can be advantageously realized (The thyristor is a self-retaining element. It is an element wherein, once the thyristor is triggered on by the application of a gate signal, when a trigger pulse is applied thereto, the thyristor can retain the ON state even though the gate signal disappears. Because of this feature, as compared with the MOS field-effect transistor and other transistors, a level shifter circuit can be advantageously simplified. Also, a high voltage breakdown characteristic and a high current control can be easily accomplished. In other words, the chip size can be reduced considerably.). Thus the use of the thyristors can provide such a feature as shown in FIG. 5. FIG. 5 illustrates the relationship between the output voltage and the electric current of the switching element of high voltage breakdown characteristic, wherein the curve 31 is exhibited when the thyristor is employed as the switching element (during the ON state) and the curve 32 is exhibited when a MOS fieldeffect transistor or a transistor is employed as the switching element. As can be understood from this figure, as compared with the MOS field-effect transistor and the transistor, the thyristor exhibits a high output current power and a sufficiently low ON resistance. Because of this, the phenomenon hitherto experienced wherein the increase of the number of the lighting picture elements results in the reduction in luminance. Thus, the increase of the load to such an extent that no writing pulse can longer be applied sufficiently resulting in the difference between the intensity of light when the number of the picture elements lit is large and that when the number of the picture elements lit is small (i.e., resulting in the difference in luminance) can be advantageously eliminated. This thereby contributes to the improvement in display quality. The display of gradations can readily be accomplished because of the luminance characteristic, such as that discussed above, can be controlled.

Also, since the EL display device is an equivalent to a capacitor, the reduction of the output current power results in the reduction of the length of time required to effect the charging and also the reduction of the length of time required to accomplish one scan drive. In other words, the drive of the EL display device having a multiple of scanning electrodes can be accomplished and the drive is possible even though the load capacitance of one scan line is increased as a result of the increase of the data electrodes.

In the foregoing embodiment, both of the scanning electrode and the data electrodes have been shown and described as connected with the high voltage breakdown driver IC circuits having a push-pull function and employing the thyristors as the switching elements. However, the present invention can be equally applicable to the drive circuit for the EL display device wherein both of the scanning electrodes and the data electrodes are connected with high voltage breakdown driver IC circuits having only a pull-up function or only a pull-down function.

Also, in the illustrated thin film EL display device, it suffices that the driver circuit wherein the thyristors are employed as the switching elements is connected only to the electrode to which at least the writing voltage is applied. In the case of the drive circuit wherein the writing voltage is applied from the data electrodes, it is recommended to connect the driver circuit using the thyristors as the switching element to the data electrodes.

From the foregoing description of the present invention, since each of the electrodes of one of the groups of the scanning and data electrodes which applies the writing voltage to the EL layer is connected with the driver circuit of high voltage breakdown characteristic having the push-pull function or the pull-up and pull-down function and employing the thyristors as switching elements, any possible change in luminance dependent on the number of the picture elements lit can be eliminated. Further, the display of gradations can be facilitated, and a large information display capability can be achieved with the increased number of any one of the scanning electrodes and the data electrodes, all without the conventional merits being sacrificed.

Although the present invention has fully been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A driving system for driving a display device which includes a plurality of parallel scan electrodes arranged in alternating first and second groups, a plurality of parallel data electrodes arranged perpendicular to the scan electrodes and forming a picture element at each scan and data electrode intersection, and a luminescent layer sandwiched between the parallel scan and data electrodes, said driving system comprising:

first driving means for sequentially selecting and driving each of said parallel scan electrodes in said first group;

second driving means for sequentially selecting and driving each of said parallel scan electrodes in said second group; and third driving means for driving said parallel data electrodes corresponding to an input data signal to display data of said input data signal on said display device;

said first and second driving means including pull-up and pull-down thyristors corresponding to each of said parallel scan electrodes of said first and second group;

said first and second driving means each alternatingly operating to sequentially select and drive each of said parallel scan electrodes in said first and second groups, respectively, by, (a) applying a write pulse of a first polarity in a first frame to said selected scan electrode of said first group, by turning on said pull-down thyristors corresponding to said first group to thereby light certain picture elements corresponding to said selected scan electrode and each of said data electrodes corresponding to said input data signal, (b) applying a write pulse of a second polarity in a second frame to each scan electrode of said first group, by turning on said pull-up thyristors corresponding to said first group to thereby light certain picture elements corresponding to said selected scan electrode and each of said data electrodes corresponding to said input data signal, (c) applying a write pulse of said second polarity in a first frame to each scan electrode of said first of said second group by turning on said pull-up thyristors corresponding to said second group to thereby light certain picture elements corresponding to said selected scan electrode and each of said data electrodes corresponding to said input data signal, and (d) applying a write pulse of said first polarity in a second frame to said selected scan electrode of said second group by turning on the pull-down thyristors corresponding to said second group to thereby light certain picture elements corresponding to said selected scan electrode and each of said data electrodes corresponding to said input data signal.

2. A driving system as claimed in claim 1, wherein said pull-up thyristors are turned off when corresponding pull-down thyristors are turned on, and vice versa, said pull-up or pull-down thyristors being turned off to thereby ensure non-lighting of certain picture elements corresponding to said input data signal.

3. A driving system as claimed in claim 2, wherein said turning on of pull-up or pull-down thyristors creates a voltage potential across picture elements, which exceeds a threshold voltage to thereby light certain picture elements corresponding to said input data signal.

4. A driving system, as claimed in claim 3, wherein said turning off of pull-up or pull-down thyristors creates a voltage potential across picture elements, which is lower than a threshold voltage, to thereby ensure non-lighting of certain picture elements corresponding to said input data signal.

5. A driving system, as claimed in claim 1, wherein said first polarity is negative and said second polarity is positive.

6. A method for driving a display device which includes a plurality of parallel scan electrodes, each employing pull-up and pull-down thyristors as switching elements, arranged in alternating first and second groups, a plurality of parallel data electrodes, receiving input data to be displayed from an input data signal, arranged perpendicular to the scan electrodes and forming a picture element at each scan and data electrode intersection, and a luminescent layer sandwiched between the parallel scan and data electrodes, said method comprising the steps of:

(a) applying a write pulse of a first polarity in a first frame to each scan electrode of said first group sequentially selected, by switching on said pull-down thyristors corresponding to said first group to thereby light certain picture elements corresponding to said selected scan electrode and each of said data electrodes corresponding to said input data signal;

(b) applying a write pulse of a second polarity in a second frame to each scan electrode of said first group sequentially selected, by switching on said pull-up thyristors corresponding to said first group to thereby light certain picture elements corresponding to said selected scan electrode and each of said data electrodes corresponding to said input data signal;

(c) applying a write pulse of said second polarity in a first frame to each scan electrode of said second group sequentially selected, by turning on said pull-up thyristors corresponding to said second group to thereby light certain picture elements corresponding to said selected scan electrode and each of said data electrodes corresponding to said input data signal; and (d) applying a write pulse of said first polarity in a second frame to each scan electrode of said second group sequentially selected by switching on the pull-down thyristors corresponding to said second group to thereby light certain picture elements corresponding to said selected scan electrode and each of said data electrodes corresponding to said input data signal.

7. A method as claimed in claim 6, wherein said pull-up thyristors are turned off when corresponding pull-down thyristors are turned on, and vice versa, said pull-up or pull-down thyristors being turned off to thereby ensure non-lighting of certain picture elements corresponding to said input data signal.

8. A method as claimed in claim 6, wherein said turning on of pull-up or pull-down thyristors creates a voltage potential across picture elements, which exceeds a threshold voltage, to thereby light certain picture elements corresponding to said input data signal.

9. A method, as claimed in claim 8, wherein said turning off of pull-up or pull-down thyristors creates a voltage potential across picture elements, which is lower than a threshold voltage, to thereby ensure non-lighting of certain picture elements corresponding to said input data signal.

10. A method, as claimed in claim 6, wherein said first polarity is negative and said second polarity is positive.

11. A driving system for driving a display device which includes a plurality of parallel scan electrodes arranged in alternating first and second groups, a plurality of parallel data electrodes arranged perpendicular to the scan electrodes and forming a picture element at each scan and data electrode intersection, and a luminescent layer sandwiched between the parallel scan and data electrodes, said driving system comprising:

first driving means employing pull-up and pull-down thyristors as switching elements, for sequentially selecting and driving each of said parallel scan electrodes in said first group, said pull-down thyristors being switched on to apply a write pulse of a first polarity during a first frame and said pull-up thyristors being switched on to apply a write pulse of a second polarity during a second frame;

second driving means employing pull-up and pull-down thyristors as switching elements, for sequentially selecting and driving each of said parallel scan electrodes in a second group, said pull-up thyristors being switched on to apply a write pulse of said second polarity during a first frame and said pull-down thyristors being switched on to apply a write pulse of said first polarity during second frame;

said first and second driving means alternatively operating to drive each of said scan electrodes in said first and second groups; and third driving means for driving said parallel data electrodes corresponding to said input data signal thereby lighting certain picture elements at each data and scan electrode intersection in response to said first, second, and third driving means.

12. A driving system as claimed in claim 11, wherein said pull-up thyristors are switched of when corresponding pull-down thyristors are switched on, and vice versa, said pull-up or pull-down thyristors being turned off to thereby ensure non-lighting of certain picture elements corresponding to said input data signal.

13. A driving system as claimed in claim 12, wherein said switching on of pull-up or pull-down thyristors creates a voltage potential across picture elements, which exceeds a threshold voltage, to thereby light certain picture elements corresponding to said input data signal.

14. A driving system, as claimed in claim 13, wherein said switching off of pull-up or pull-down thyristors creates a voltage potential across picture elements, which is lower than a threshold voltage, to thereby ensure non-lighting of certain picture elements corresponding to said input data signal.

15. A driving system, as claimed in claim 11, wherein said first polarity is negative and said second polarity is positive.

16. A method for driving a display device which includes a plurality of parallel scan electrodes arranged in alternating first and second groups, a plurality of parallel data electrodes arranged perpendicular to the scan electrodes and forming a picture element at each scan and data electrode intersection, and a luminescent layer sandwiched between the parallel scan and data electrodes, said method comprising the steps of:

(a) sequentially selecting and driving each of said parallel scan electrodes in said first group by, (1) switching on pull-down thyristors to apply a write pulse of a first polarity during a first frame, and (2) switching on said pull-up thyristors to apply a write pulse of a second polarity during a second frame;

(b) sequentially selecting and driving each of said parallel scan electrodes in a second group by, (1) switching on said pull-up thyristors to apply a write pulse of said second polarity during a first frame, and (2) switching on said pull-down thyristors to apply a write pulse of said first polarity during second frame;

(c) said step of (a) and (b) alternately occurring to drive each of said scan electrodes in said first and second groups;

(d) driving said parallel data electrodes corresponding to said input data signal; and (e) lighting certain picture elements at each data and scan electrode intersection in response to said steps of (a), (b), (c), and (d).

17. A method as claimed in claim 16, wherein said pull-up thyristors are turned off when corresponding pull-down thyristors are turned on, and vice versa, said pull-up or pull-down thyristors being turned off to thereby ensure non-lighting of certain picture elements corresponding to said input data signal.

18. A method as claimed in claim 17, wherein said turning on of pull-up or pull-down thyristors creates a voltage potential across picture elements, which exceeds a threshold voltage, to thereby light certain picture elements corresponding to said input data signal.

19. A method, as claimed in claim 18, wherein said turning off of pull-up or pull-down thyristors creates a voltage potential across picture elements, which is lower than a threshold voltage, to thereby ensure non-lighting of certain picture elements corresponding to said input data signal.

20. A method, as claimed in claim 16, wherein said first polarity is negative and said second polarity is positive.

* * * * *